US008471839B2

(12) United States Patent
Lin

(10) Patent No.: US 8,471,839 B2
(45) Date of Patent: Jun. 25, 2013

(54) SIGNAL CONTROL CIRCUIT AND METHOD THEREOF, LIQUID CRYSTAL DISPLAY AND TIMING CONTROLLER THEREOF

(75) Inventor: Hao-Shun Lin, Taoyuan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 1179 days.

(21) Appl. No.: 12/168,924

(22) Filed: Jul. 8, 2008

(65) Prior Publication Data

US 2009/0073157 A1 Mar. 19, 2009

(30) Foreign Application Priority Data

Sep. 17, 2007 (TW) ..... 96134699 A

(51) Int. Cl.
*G09G 5/00* (2006.01)

(52) U.S. Cl.
USPC ..... 345/212

(58) Field of Classification Search
USPC ..... 345/211, 212
See application file for complete search history.

(56) References Cited

U.S. PATENT DOCUMENTS

| | | | | |
|---|---|---|---|---|
| 5,001,430 | A | 3/1991 | Peterman et al. | |
| 7,825,919 | B2 * | 11/2010 | Woo et al. | 345/211 |
| 2008/0143662 | A1 * | 6/2008 | Hong | 345/92 |
| 2008/0259061 | A1 * | 10/2008 | Lin | 345/204 |

FOREIGN PATENT DOCUMENTS

| | | |
|---|---|---|
| CN | 1573880 | 2/2005 |
| CN | 1969341 | 5/2007 |
| JP | 2001272961 | 10/2001 |
| TW | 200411604 | 7/2004 |
| TW | I237229 | 8/2005 |
| TW | 200603063 | 1/2006 |
| TW | 200606805 | 2/2006 |
| TW | I253037 | 4/2006 |

OTHER PUBLICATIONS

"1st Office Action of China counterpart application", issued on Feb. 5, 2010, p. 1-p. 4.
"Office Action of Taiwan Counterpart Application", issued on Aug. 20, 2012, p1~p9.
Jacob Millman, "Microelectronics: Digital and Analog Circuits and Systems", Mar. 1979, p1~p3, Mcgraw-Hill.

* cited by examiner

*Primary Examiner* — Amr Awad
*Assistant Examiner* — Randal Willis
(74) *Attorney, Agent, or Firm* — Jianq Chyun IP Office

(57) ABSTRACT

A signal control circuit and a method thereof, and a liquid crystal display (LCD) and a timing controller thereof are provided. The signal control circuit of the present invention maintains a voltage level of a driving signal output from the timing controller for driving data drivers to the supply voltage, such that the data drivers may cease outputting display data to the liquid crystal display panel when the LCD is turned off. Therefore, the image sticking, ghost image and fan-out phenomenon occurred when the LCD is turned off may be avoided.

25 Claims, 6 Drawing Sheets

SIGNAL CONTROL CIRCUIT AND METHOD THEREOF, LIQUID CRYSTAL DISPLAY AND TIMING CONTROLLER THEREOF

CROSS-REFERENCE TO RELATED APPLICATION

This application claims the priority benefit of Taiwan application serial no. 96134699, filed on Sep. 17, 2007. The entirety of the above-mentioned patent application is hereby incorporated by reference herein and made a part of specification.

BACKGROUND OF THE INVENTION

1. Field of the Invention

The present invention relates to a liquid crystal display (LCD) without image sticking, ghost image and fan-out phenomenon when the LCD is turned off. More particularly, the present invention relates to a timing controller for the LCD and a signal control circuit and a method thereof.

2. Description of Related Art

Recently, thin film transistor liquid crystal displays (TFT-LCDs) have been widely used and have become one of a mainstream in the display market for substituting the cathode ray tube (CRT). With development of semiconductor technology, the TFT-LCD has been developed such advantages as low power consumption, smaller size and light weight, high resolution, high color saturation, and long lifespan, such that the TFT-LCD has been widely applied to electronic products closely related to our daily life, such as LCD monitors and LCD TVs.

FIG. 1 is a block diagram illustrating a driving mode of a conventional TFT-LCD. FIG. 2 is a diagram illustrating a driving waveform of the TFT-LCD of FIG. 1 when the TFT-LCD is turned off. Referring to FIG. 1 and FIG. 2, generally, a turning off process of the TFT-LCD includes the following steps. First, when supplying of a clock CLK and a data D of a low voltage differential signal (LVDS) from a bus 101 to a timing controller 103 stops, during a time interval between a time point A and a time point B on a timeline T, a driving signal TPO (generally is a TTL signal) required for driving data drivers (data driving ICs) 105*a*~105*n* output from the timing controller 103 may be gradually decreased to a ground level GND. Next, when the driving signal TPO is gradually decreased to the ground level GND (i.e. after the time point B), the voltage level of a supply voltage VDD provided by a power supply unit 107 is decreased from a high voltage level H to the ground level GND. These steps are necessary for the turning off process of the TFT-LCD.

However, during the time interval between the time point A to the time point B, the driving signal TPO is in a state FRS without control (i.e. a free run state), and is still taken as an effective signal by the data driver 105*a*~105*n* during this time interval. Therefore, the data driver 105*a*~105*n* may still output a display data DD to an LCD panel 109 according to an image signal VD and a timing signal SCLK provided by the timing controller 103 before the TFT-LCD is turned off, and now an image displayed by the LCD panel 109 is a last frame of image displayed before the TFT-LCD is turned off, and this is the so-called image sticking phenomenon.

Moreover, since the voltage level of the supply voltage VDD provided by the power supply unit 107 may be decreased from the high voltage level H to the ground level GND only after the time point B, residual charges within a pixel array (not shown) of the LCD panel 109 may be gradually dissipated after the TFT-LCD is turned off. If a driving method of the LCD panel 109 is a line inversion driving method, charge dissipation will be performed when nearly a half of the pixels within the pixel array of the LCD panel 109 are in a high level, which may further lead to the so-called fan-out phenomenon of the LCD panel 109.

Therefore, if the driving mode of the TFT-LCD of FIG. 1 is applied, the image sticking and fan-out phenomenon may occur when the TFT-LCD is turned off, and liquid crystal molecules of the pixels within the LCD panel 109 may be deteriorated due to repetition of the above two phenomenon, which may result in a fact that a previous image may be retained each time when the LCD panel 109 displays a new image, which is the so-called ghost image phenomenon.

SUMMARY OF THE INVENTION

Accordingly, the present invention is directed to a signal control circuit and a method thereof, by which when an LCD is turned off, a voltage level of a driving signal (TPO) output from a timing controller for driving data drivers is maintained to a supply voltage (i.e. a high level voltage), such that the data drivers may cease outputting data to an LCD panel.

The present invention is further directed to a timing controller, in which a flip-flop is embedded, and when an LCD is turned off, a voltage level of a driving signal output from a timing controller for driving data drivers is maintained to a supply voltage, such that the data drivers may cease outputting data to an LCD panel.

The present invention is further directed to an LCD, in which the aforementioned signal control circuit or the timing controller is applied, and when the LCD is turned off, residual charges within a pixel array of an LCD panel may be quickly dissipated, so as to avoid an image sticking, a ghost image and a fan-out phenomenon of the LCD.

Based on aforementioned and other objectives, the signal control circuit provided by the present invention includes a bus and a control unit, wherein the bus is used for transmitting a low voltage differential signal (LVDS) clock. The control unit includes a transistor, wherein a source of the transistor is electrically connected to a reference level, a gate of the transistor is used for receiving the LVDS clock from the bus, and a drain of the transistor is electrically connected to the supply voltage and is suitable for outputting the driving signal. Wherein, when the voltage level of a common-mode voltage of the LVDS clock drops to the reference level, the voltage level of the driving signal is maintained to the supply voltage.

According to another aspect of the present invention, a signal control method provided by the present invention includes the following steps. First, a voltage level of a common-mode voltage of an LVDS clock provided to a timing controller is detected. Next, when the voltage level of the common-mode voltage of the LVDS clock drops to a reference level, the voltage level of a driving signal output from the timing controller for driving data drivers is maintained to a supply voltage.

According to still another aspect of the present invention, the timing controller provided by the present invention includes at least one flip-flop, and when the voltage level of the common-mode voltage of the LVDS clock received by the timing controller drops to the reference level, the voltage level of the driving signal output from the timing controller for driving the data drivers is maintained to the supply voltage under control of the flip-flop, wherein the reference level comprises a ground level, and the supply voltage comprises a high level voltage.

According to yet another aspect of the present invention, one of the LCD provided by the present invention includes the aforementioned signal control circuit, a plurality of the data drivers and the LCD panel. Wherein, the signal control circuit is used for detecting the voltage level of the common-mode voltage of the LVDS clock, such that when the voltage level of the common-mode voltage of the LVDS clock drops to the reference level, the voltage level of the driving signal may be maintained to the supply voltage. The plurality of data drivers is electrically connected to the signal control circuit, and each of the data drivers is used for receiving the driving signal maintained to the supply voltage when the aforementioned voltage level of the common-mode voltage drops to the reference level, so as to cease outputting a corresponding display data. The LCD panel is electrically connected to each of the data drivers for correspondingly receiving the display data output from each of the data drivers, so as to display an image, and when the voltage level of the common-mode voltage drops to the reference level, the residual charges within the pixel array of the LCD panel may be quickly dissipated.

According to yet another aspect of the present invention, another LCD provided by the present invention includes a plurality of the data drivers, the aforementioned timing controller and the LCD panel. Wherein, each of the data drivers is used for receiving the corresponding driving signal, an image signal and a clock signal. The timing controller is electrically connected to each of the data drivers and includes at least one flip-flop. The timing controller may receive the LVDS clock and the LVDS data from the bus, and process the received LVDS clock and the LVDS data to individually provide the clock signal, the image signal and the driving signal to the corresponding data driver.

The LCD panel is electrically connected to each of the data drivers for correspondingly receiving the display data from each of the data drivers to display an image. Wherein, when the voltage level of the common-mode voltage of the LVDS clock received by the timing controller drops to the reference level, the voltage level of the driving signal may be maintained to the supply voltage under control of the flip-flop, and each of the data drivers may receive the driving signal maintained to the supply voltage to cease outputting the display data, such that the residual charges within the pixel array of the LCD panel may be quickly dissipated.

According to the signal control circuit and the method thereof provided by the present invention, when the voltage level of the common-mode voltage of the LVDS clock supplied to the timing controller drops to the reference level, the voltage level of the driving signal output from the timing controller for driving the data drivers may be maintained to the supply voltage, such that the data drivers may cease outputting the display data to the LCD panel, and accordingly the residual charges within the pixel array of the LCD panel may be quickly dissipated, and the image sticking, ghost image and fan-out phenomenon occurred when the LCD is turned off may be avoided.

Furthermore, the timing controller provided by the present invention may include a flip-flop, and when the voltage level of the common-mode voltage of the LVDS clock received by the timing controller drops to the reference level, the voltage level of the driving signal output from the timing controller for driving the data drivers may be maintained to the supply voltage under control of the flip-flop, such that the data driver may cease outputting the display data to the LCD panel, which may also avoid the image sticking, ghost image and fan-out phenomenon occurred when the LCD is turned off.

In order to make the aforementioned and other objects, features and advantages of the present invention comprehensible, a preferred embodiment accompanied with figures is described in detail below.

DESCRIPTION OF EMBODIMENTS

The technical functions to be achieved by the present invention are intended to solve the problems such as an image sticking, a ghost image and a fan-out phenomenon caused by the residual charges within pixel array of an LCD panel when a conventional TFT-LCD is turned off. Aspects and advantages of the present invention will be set forth in the description of the following embodiments for those skilled in the art.

Figure 1:
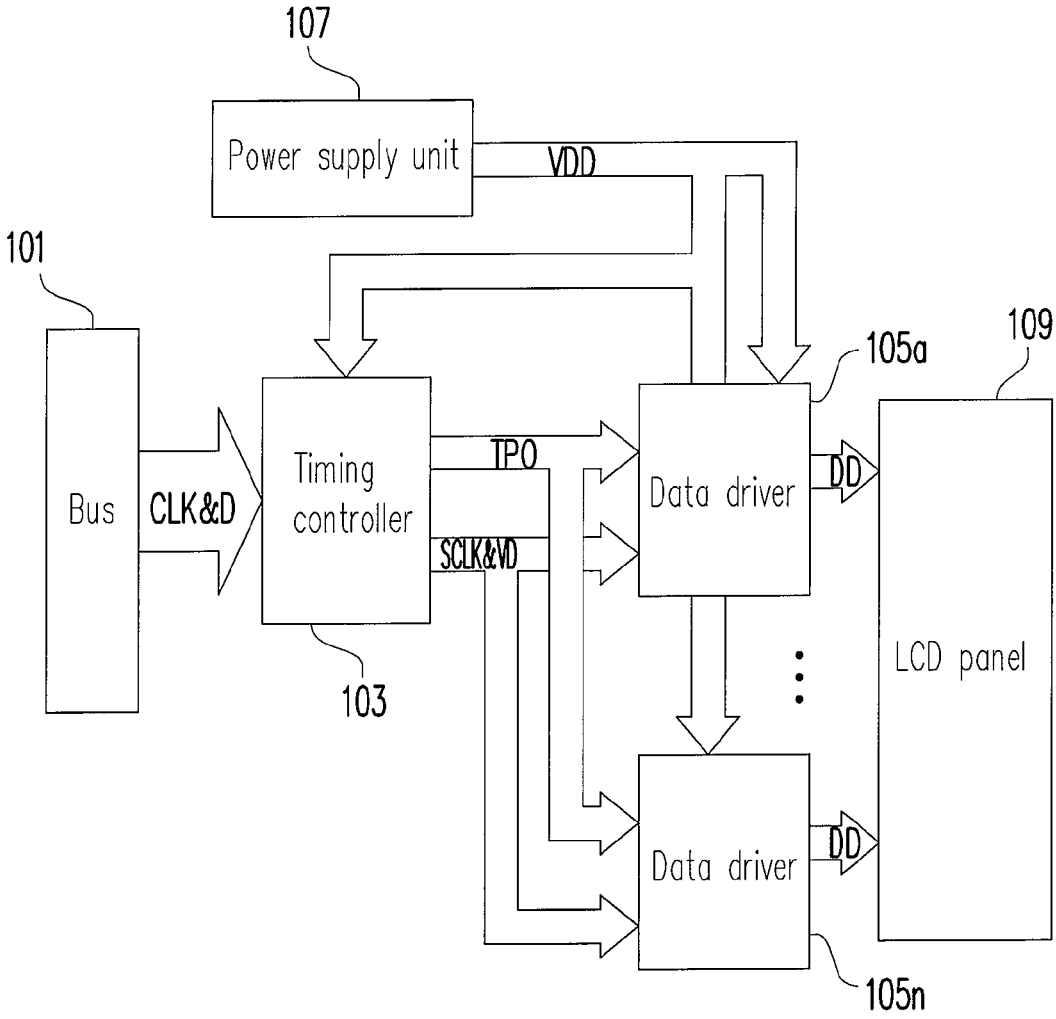
FIG. 1 (PRIOR ART)
FIG. 1 is block diagram illustrating a driving mode of a conventional TFT-LCD.
Figure 2:
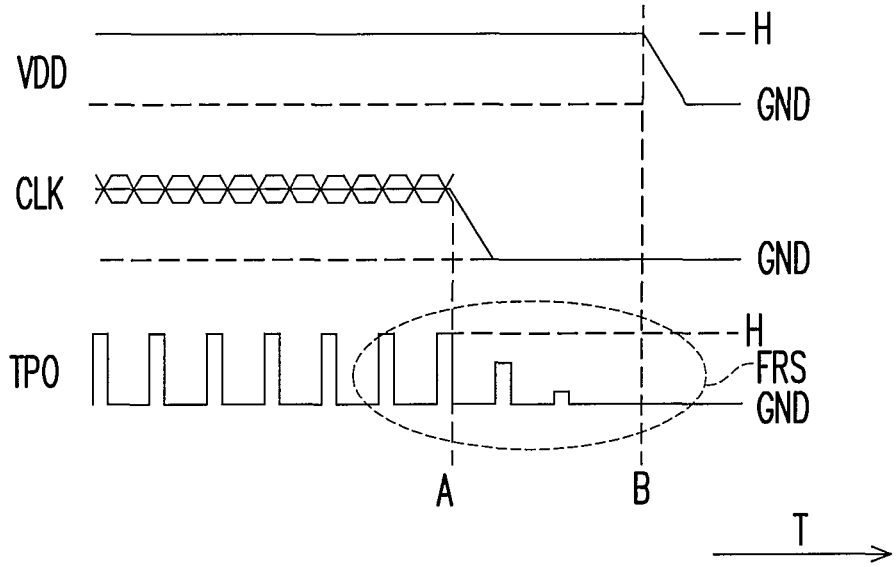
FIG. 2 (PRIOR ART)
FIG. 2 is a diagram illustrating a driving waveform of the TFT-LCD of FIG. 1 when the TFT-LCD is turned off.
Figure 3:
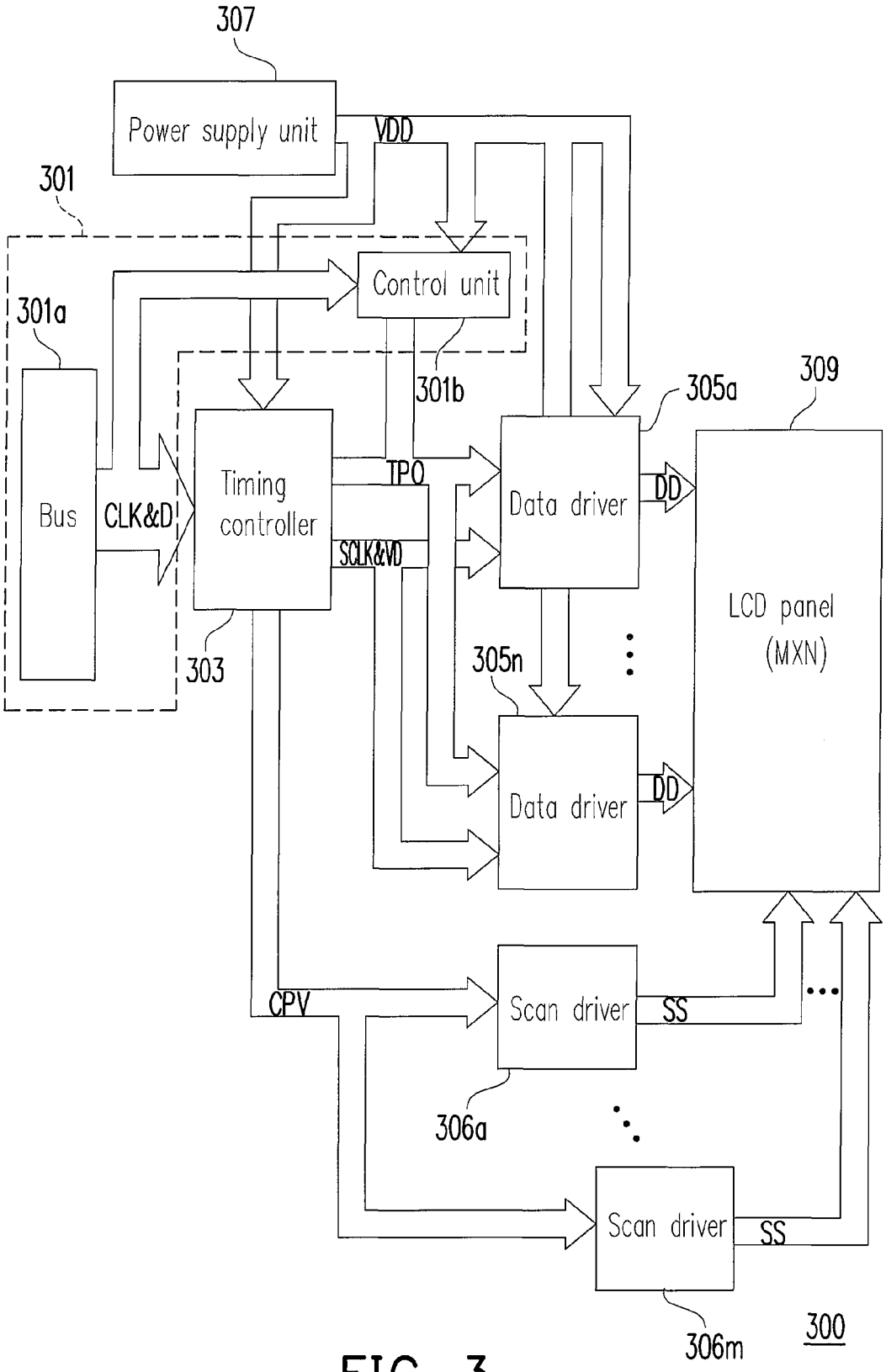
FIG. 3 is block diagram illustrating a driving mode of an LCD according to an exemplary embodiment of the present invention.

FIG. 3 is a block diagram illustrating a driving mode of an LCD 300 according to an exemplary embodiment of the present invention. Referring to FIG. 3, the LCD 300 includes a signal control circuit 301, a timing controller 303, N data drivers (for example, data driving ICs) 305*a*~305*n*, M scan drivers (for example, scan driving ICs) 306*a*~306*m*, a power supply unit 307, and an LCD panel 309. Wherein, the signal control circuit 301 includes a bus 301*a* and a control unit 301*b*, a resolution of the LCD panel 309 is M×N, where M and N are positive integers.

In the present embodiment, the signal control circuit 301 is used for detecting a voltage level $V_{CMLVDS}$ of a common-mode voltage of an LVDS clock CLK transmitted from the bus 301*a*, and when the voltage level of the common-mode voltage of the LVDS clock CLK drops to a reference level (for example, a ground level GND), the voltage level of a driving signal TPO output from the timing controller 303 for driving data drivers 305*a*~305*n* is maintained to a supply voltage VDD (for example, a high level voltage). Generally, when the voltage level of the common-mode voltage of the LVDS clock CLK drops to the reference level, it represents the LCD 300 is in a turned-off state. The above supply voltage VDD, the reference level and the power required for operating the LCD 300 are all provided by the power supply unit 307.

The data drivers 305*a*~305*n* are electrically connected to the signal control circuit 301. When the voltage level of the common-mode voltage of the LVDS clock CLK drops to the reference level, each of the data drivers 305*a*~305*n* may receive the driving signal TPO maintained to the supply voltage VDD, and may cease outputting a corresponding display data DD to the LCD panel 309 according to the component features of the data drivers.

The scan drivers 306*a*~306*m* are electrically connected to the LCD panel 309, and each of the scan drivers provides a scan signal SS to sequentially activate a row of pixels (not shown) according to a basic timing CPV output from the timing controller 303, such that the row of pixels may correspondingly receive the display data DD from the data drivers 305*a*~305*n*.

The timing controller 303 is electrically connected to the signal control circuit 301, and may receive the LVDS clock CLK and the LVDS data D from the bus 301*a* and process the received LVDS clock CLK and the LVDS data D to individually provide a required clock signal SCLK, an image signal VD and the driving signal TPO to each of the data drivers 305*a*~305*n*, and provide the required basic timing CPV to each of the scan drivers 306*a*~306*m*.

The LCD panel 309 is electrically connected to the data drivers 305*a*~305*n* and the scan drivers 306*a*~306*m*. When each row of the pixels within the LCD panel 309 is sequentially activated by the scan drivers 306*a*~306*m*, and correspondingly receives the display data DD output from each of the data drivers 305*a*~305*n*, an image may be displayed on the LCD panel 309. Wherein, when the voltage level $V_{CMLVDS}$ of the common-mode voltage of the LVDS clock CLK drops to the reference level, the data drivers 305*a*~305*n* may cease outputting the corresponding display data DD to the LCD panel 309, and therefore residual charges within the pixel array (not shown) of the LCD panel 309 may be quickly dissipated, and the image sticking, ghost image and fan-out phenomenon occurred when the LCD 300 is turned off may be avoided.

Accordingly, how to detect the voltage level $V_{CMLVDS}$ of the common-mode voltage of the LVDS clock CLK transmitted from the bus 301*a* is one of the key techniques of the present embodiment, and the detecting method will be further described in detail as follows.

Figure 4:
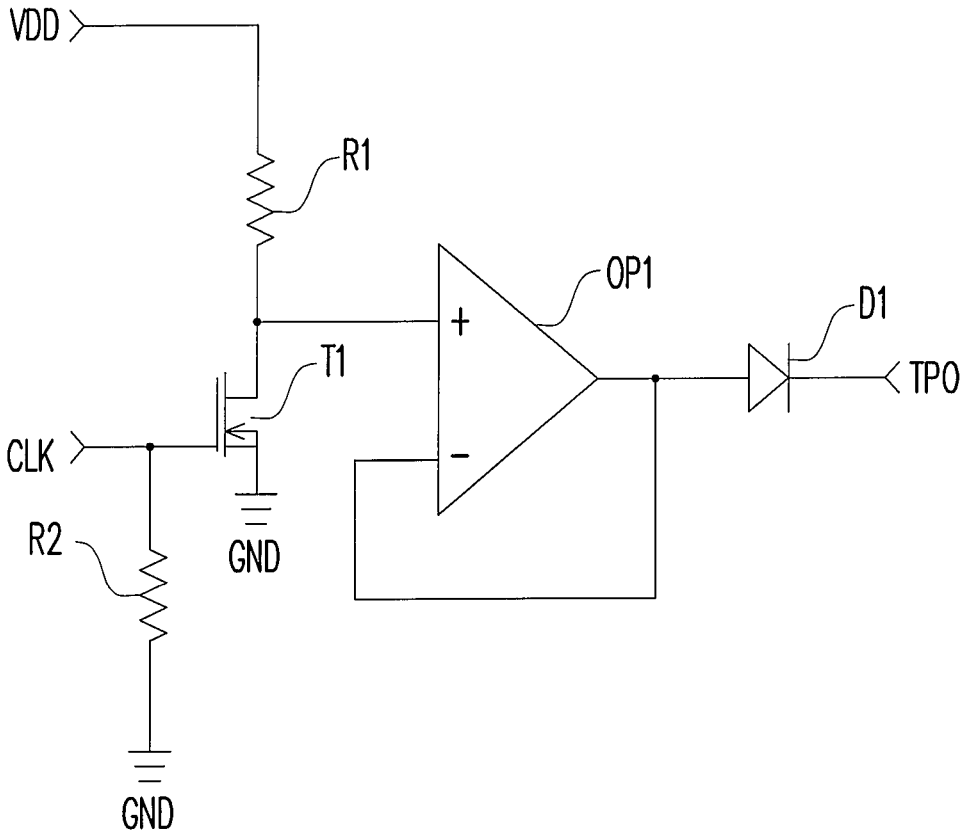
FIG. 4 is a circuit diagram of a control unit according to an embodiment of the present invention.

In the present embodiment, the voltage level $V_{CMLVDS}$ of the common-mode voltage of the LVDS clock CLK transmitted from the bus 301*a* may be detected by the control unit 301*b*. FIG. 4 is a circuit diagram illustrating the control unit 301*b* according to the present embodiment. Referring to FIG. 3 and FIG. 4, the control unit 301*b* includes a transistor T1 (for example, a N-channel depletion mode metal-oxide-semiconductor field-effect transistor, MOSFET), a first resistor R1, a second resistor R2, a gain amplifier OP1, and a diode D1. A gate of the transistor T1 may receive the LVDS clock CLK from the bus 301*a*, and is electrically connected to the reference level (i.e. the ground level) via the second resistor R2.

A source of the transistor T1 is electrically connected to the reference level, and a drain of the transistor T1 is electrically connected to a positive input terminal (+) of the gain amplifier OP1, and is electrically connected to the supply voltage VDD (i.e. the high level voltage) via the first resistor R1. A negative input terminal (−) and an output terminal of the gain amplifier OP1 are electrically connected to an anode of the diode D1, and a cathode of the diode D1 may output the driving signal TPO to the data drivers 305*a*~305*n*. Wherein, the gain amplifier OP1 may work as a unity gain amplifier here.

Therefore, according to the circuit diagram of the control unit 301*b*, when the gate of the transistor T1 continually receives the LVDS clock CLK from the bus 301*a*, the transistor T1 may be continually turned on in response to the voltage level $V_{CMLVDS}$ of the common-mode voltage of the LVDS clock CLK, and after each several LVDS clock CLK is received, the timing controller 303 may provide the driving signal TPO via the gain amplifier OP1 and the diode D1 to drive the data drivers 305*a*~305*n*.

However, when the bus 301*a* ceases outputting the LVDS clock CLK, namely, when the LCD 300 is in a turned-off state, the transistor T1 is turned off in response to the voltage level $V_{CMLVDS}$ of the common-mode voltage of the LVDS clock CLK received by the gate of the transistor T1 from the bus 301*a*, and now the voltage level of the positive input terminal (+) of the gain amplifier OP1 may be pulled up to the supply voltage VDD, such that the voltage level of the driving signal TPO output from the timing controller 303 may be maintained to the supply voltage VDD, and accordingly the data drivers 305*a*~305*n* may cease outputting the corresponding display data DD to the LCD panel 309.

Figure 5:
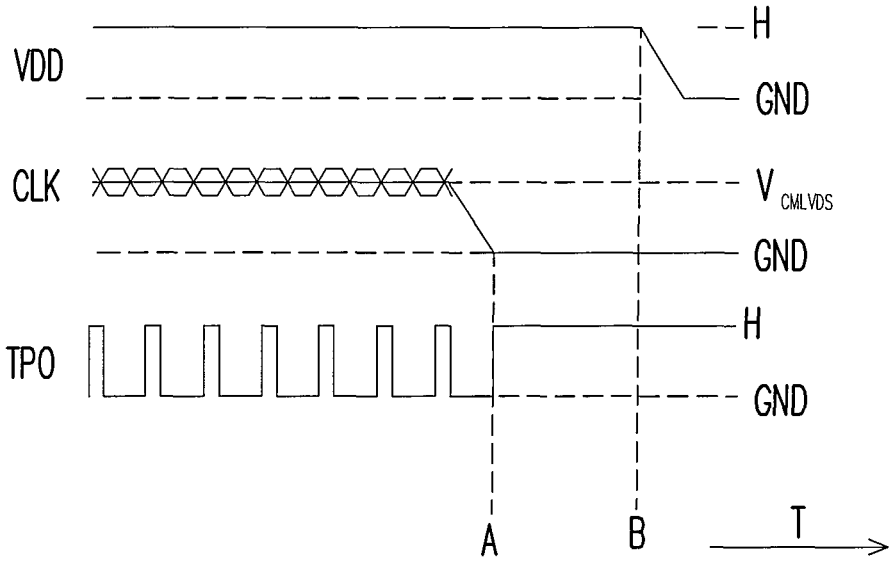
FIG. 5 is a diagram illustrating a driving waveform of the LCD of FIG. 3 when the LCD is turned off.

FIG. 5 is a diagram illustrating a driving waveform of the LCD 300 of FIG. 3 when the LCD is turned off. Referring to FIGS. 3 through 5, a turning off process of the LCD 300 of the present embodiment is similar to that of the TFT-LCD in the related art, except that when the bus 301*a* ceases outputting the LVDS clock CLK and the LVDS data D to the timing controller 303, and during a time interval between a time point A and a time point B on a timeline T, the voltage level of the driving signal TPO output from the timing controller 303 for driving the data drivers 305*a*~305*n* may be maintained to the supply voltage VDD, and therefore the data drivers 305*a*~305*n* may cease outputting the corresponding display data DD to the LCD panel 309, and residual charges within the pixel array of the LCD panel 309 may be quickly dissipated. Thus, the image sticking, ghost image and fan-out phenomenon occurred when the LCD 300 is turned off may be avoided.

It should be noted that the circuit structure of the control unit 301*b* used for detecting the voltage level $V_{CMLVDS}$ of the common-mode voltage of the LVDS clock CLK transmitted from the bus 301*a* is not limited by the circuit structure disclosed in the embodiment of FIG. 4. Namely, as long as the voltage level of the driving signal TPO output from the timing controller 303 for driving the data drivers 305*a*~305*n* is maintained to the supply voltage VDD when the LCD 300 is turned off, the circuit structure thereof is considered to be within the scope of the present invention.

Figure 6:
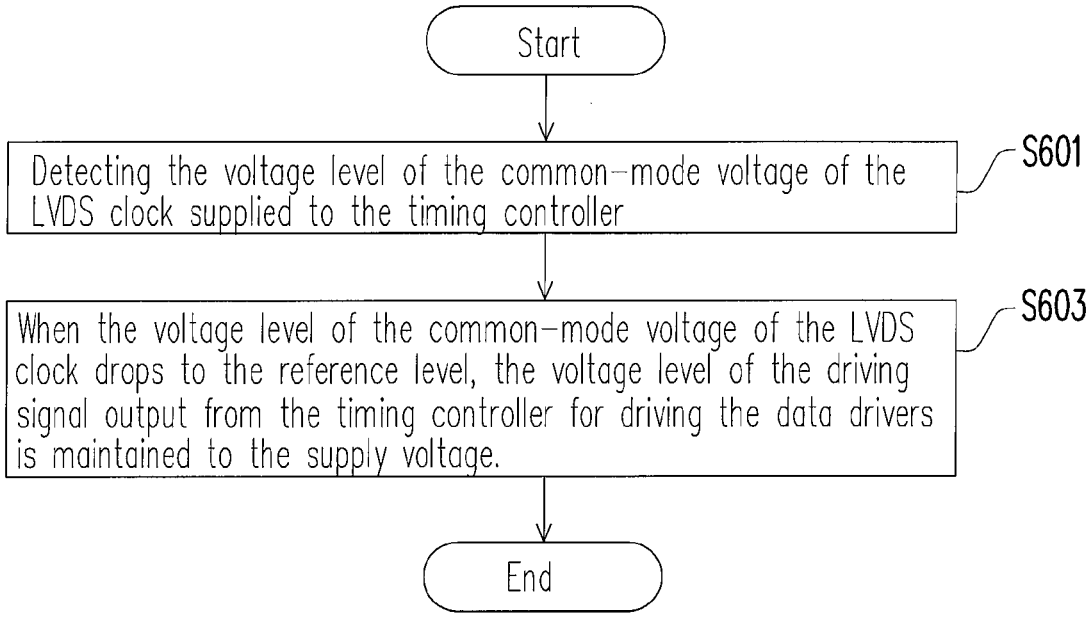
FIG. 6 is flowchart of a signal control method according to an exemplary embodiment of the present invention.

To achieve the technical functions of the aforementioned control unit 301*b*, a signal control method is provided as follows. FIG. 6 is a flowchart of a signal control method according to an exemplary embodiment of the present invention. Referring to FIG. 6, the signal control method includes the following steps. First, in step S601, the voltage level of the common-mode voltage of the LVDS clock supplied to the timing controller is detected. Next, in step S603, when the voltage level of the common-mode voltage of the LVDS clock drops to the reference level, the voltage level of the driving signal output from the timing controller for driving the data drivers (data driving ICs) is maintained to the supply voltage.

In the present embodiment, the voltage level of the common-mode voltage of the LVDS clock is detected by receiving the LVDS clock through the gate of the transistor (N-channel MOSFET), wherein the source of the transistor is electrically connected to the reference level (for example, the ground level), and the drain of the transistor is electrically connected to the supply voltage (for example, the high level voltage) and may output the driving signal. Then, the voltage level of the common-mode voltage of the LVDS clock is decided according to whether or not the transistor is turned on. Wherein, when the transistor is turned off, the voltage level of the common-mode voltage of the LVDS clock is the reference level.

Accordingly, when the voltage level of the common-mode voltage of the LVDS clock drops to the reference level, the voltage level of the driving signal output from the timing controller for driving the data drivers may be maintained to the supply voltage. Therefore, the data drivers may cease outputting the corresponding display data to the LCD panel based on the component features of the data drivers, and residual charges within the pixel array of the LCD panel may be quickly dissipated. Thus, the image sticking, ghost image and fan-out phenomenon occurred when the LCD is turned off may be avoided.

Furthermore, to avoid the image sticking, ghost image and fan-out phenomenon occurred when the LCD 300 is turned off, another embodiment of the present invention is provided, in which at least one flip-flop (for example, a D flip-flop, a T flip-flop, a RS flip-flop or a JK flip flop, not shown) is embedded in the timing controller 303. When the voltage level of the common-mode voltage of the LVDS clock transmitted from the bus 301 a drops to the reference level, the voltage level of the driving signal TPO provided to the data drivers 305*a*~305*n* by the timing controller 303 may be maintained to the supply voltage under control of the embedded flip-flop, and each of the data drivers 305*a*~305*n* may receive the driving signal TPO maintained to the supply voltage to cease outputting the display data DD, such that the residual charges within the pixel array of the LCD panel 309 may be quickly dissipated. By such means, the control unit 301*b* of the LCD 300 may be omitted to save a fabrication cost, and the image sticking, ghost image and fan-out phenomenon may be avoided accordingly.

In summary, according to the signal control circuit and the method thereof provided by the present invention, by detecting the voltage level of the common-mode voltage of the LVDS clock supplied to the timing controller, when the voltage level of the common-mode voltage drops to the reference level, the voltage level of the driving signal output from the timing controller for driving the data drivers may be maintained to the supply voltage, such that the data driver may cease outputting the display data to the LCD panel, and the residual charges within the pixel array of the LCD panel may be quickly dissipated, and accordingly the image sticking, ghost image and fan-out phenomenon may be avoided.

Furthermore, the timing controller provided by the present invention may include a flip-flop, and when the voltage level of the common-mode voltage of the LVDS clock received by the timing controller drops to the reference level, the voltage level of the driving signal output from the timing controller for driving the data drivers may be maintained to the supply voltage under control of the flip-flop, such that the data drivers may cease outputting the display data to the LCD panel, and accordingly the image sticking, ghost image and fan-out phenomenon occurred when the LCD is turned off may be avoided, and the fabrication cost may be reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A signal control circuit, suitable for a liquid crystal display (LCD), the signal control circuit comprising:

a bus, for transmitting a low voltage differential signal (LVDS) clock supplied to a timing controller of the LCD; and a control unit, comprising a transistor having a source, a drain and a gate, wherein the source is electrically connected to a reference level, the gate is used for receiving the LVDS clock, and the drain is electrically connected to a high level supply voltage, wherein the control unit is configured to detect a voltage level of a common-mode voltage of the LVDS clock, wherein when the control unit detects that the voltage level of the common-mode voltage of the LVDS clock drops to the reference level, a voltage level of a driving signal, which is output from the timing controller and required for driving a plurality of data drivers of the LCD by the timing controller, is maintained by the control unit to the high level supply voltage and then the driving signal with the high level supply voltage is supplied to the plurality of data drivers of the LCD, such that output from the data drivers is stopped outputting to an LCD panel of the LCD, wherein residual charges within pixel array of the LCD panel are quickly dissipated in response to the stopped output of the data drivers.

2. The signal control circuit as claimed in claim 1, wherein the control unit further comprises:

a unity gain amplifier, having an input connected to the drain of the transistor; and a diode, having an anode connected to an output of the unity gain amplifier, and a cathode coupled to the driving signal.

3. The signal control circuit as claimed in claim 2, wherein the unity gain amplifier comprises a positive input terminal served as the input of the unity gain amplifier, a negative input terminal and an output terminal served as the output of the unity gain amplifier, wherein the positive input terminal is electrically connected to the drain, and the negative input terminal and the output terminal are electrically connected to one another to couple to the driving signal.

4. The signal control circuit as claimed in claim 3, wherein the anode is electrically connected to the output terminal, and the cathode is coupled to the driving signal.

5. The signal control circuit as claimed in claim 1, wherein the control unit further comprises:

a first resistor, electrically connected between the high level supply voltage and the drain; and a second resistor, electrically connected between the reference level and the gate.

6. The signal control circuit as claimed in claim 1, wherein the reference level comprises a ground level.

7. A signal control method, suitable for a liquid crystal display (LCD), the signal control method comprising:

detecting a voltage level of a common-mode voltage of an LVDS clock supplied to a timing controller of the LCD; and maintaining a voltage level of a driving signal, which is output from the timing controller and required for driving a plurality of data drivers of the LCD by the timing controller, to a high level supply voltage when the voltage level of the common-mode voltage drops to a reference level, such that the driving signal with the high level supply voltage is supplied to the data drivers, and output from the data drivers is stopped outputting to an LCD panel of the LCD, wherein residual charges within pixel array of the LCD panel are quickly dissipated in response to the stopped output of the data drivers.

8. The signal control method as claimed in claim 7, wherein the step of detecting of the voltage level of the common-mode voltage comprises:

receiving the LVDS clock through a gate of a transistor, wherein a source of the transistor is electrically connected to the reference level, and a drain of the transistor is electrically connected to the high level supply voltage and is coupled to the driving signal through a series-connected unity gain amplifier and diode; and deciding the voltage level of the common-mode voltage based on whether or not the transistor is turned on, wherein when the transistor is turned off, the voltage level of the common-mode voltage is the reference level.

9. The signal control method as claimed in claim 7, wherein the reference level comprises a ground level.

10. A liquid crystal display (LCD), comprising:

an LCD panel;

a plurality of data drivers; and a signal control circuit, for detecting a voltage level of a common-mode voltage of an LVDS clock supplied to a timing controller of the LCD, so as to maintain a voltage level of a driving signal, which is output from the timing controller and required for driving the plurality of data drivers of the LCD by the timing controller, to a high level supply voltage when the voltage level of the common-mode voltage drops to a reference level, wherein the plurality of data drivers are electrically connected to the signal control circuit and the LCD panel, wherein output from the data drivers is stopped outputting to the LCD panel in response to the driving signal maintained to the high level supply voltage when the voltage level of the common-mode voltage drops to the reference level, wherein residual charges within pixel array of the LCD panel are quickly dissipated in response to the stopped output of the data drivers.

11. The LCD as claimed in claim 10 further comprising a plurality of scan drivers electrically connected to the LCD panel, wherein each of the scan drivers provide a scan signal according to a basic timing to sequentially activate a corresponding row of pixels, such that the row of pixels may correspondingly receive the display data output from each of the data drivers.

12. The LCD as claimed in claim 11, wherein the signal control circuit comprises:

a bus, for transmitting the LVDS clock; and a control unit, comprising a transistor having a source, a drain and a gate, wherein the source is electrically connected to the reference level, the gate is used for receiving the LVDS clock, and the drain is electrically connected to the high level supply voltage.

13. The LCD as claimed in claim 12, wherein the control unit further comprises:

a unity gain amplifier, having an input connected to the drain of the transistor; and a diode, having an anode connected to an output of the unity gain amplifier, and a cathode coupled to the driving signal.

14. The LCD as claimed in claim 13, wherein the unity gain amplifier comprises a positive input terminal served as the input of the unity gain amplifier, a negative input terminal and an output terminal served as the output of the unity gain amplifier, wherein the positive input terminal is electrically connected to the drain, and the negative input terminal and the output terminal are electrically connected to one another to couple to the driving signal.

15. The LCD as claimed in claim 13, wherein the anode is electrically connected to the output terminal, and the cathode is coupled to the driving signal.

16. The LCD as claimed in claim 12, wherein the control unit further comprises:

a first resistor, electrically connected between the high level supply voltage and the drain; and a second resistor, electrically connected between the reference level and the gate.

17. The LCD as claimed in claim 12, wherein the timing controller is electrically connected to the signal control circuit, and configured for receiving and processing the LVDS clock and an LVDS data transmitted from the bus to individually provide a required clock signal, an image signal and the driving signal to each of the data drivers, and provide the required basic timing to each of the scan drivers.

18. The LCD as claimed in claim 12, further comprising a power supply unit for providing the high level supply voltage, the reference level and power required for operating the LCD.

19. The LCD as claimed in claim 10, wherein the reference level comprises a ground level.

20. A timing controller, suitable for a liquid crystal display (LCD), the timing controller characterized by:

at least one flip-flop, for controlling a voltage level of a driving signal, which is output from the timing controller and required for driving a plurality of data drivers by the timing controller, to be maintained to a high level supply voltage when a voltage level of a common-mode voltage of an LVDS clock received by the timing controller drops to a reference level by a detection of the flip-flop, wherein the reference level comprises a ground level, and the high level supply voltage comprises a high level voltage, wherein output from the data drivers is stopped outputting to an LCD panel of the LCD in response to the driving signal maintained to the supply voltage, wherein residual charges within pixel array of the LCD panel are quickly dissipated in response to the stopped output of the data drivers.

21. The timing controller as claimed in claim 20, wherein the flip-flop comprises a D flip-flop, a T flip-flop, an RS flip-flop or a JK flip-flop.

22. A liquid crystal display (LCD), comprising:

a plurality of data drivers, each of the data drivers receiving a corresponding driving signal, an image signal and a clock signal;

a timing controller, electrically connected to the data drivers and comprising at least one flip-flop, wherein the timing controller is used for receiving and processing an LVDS clock and an LVDS data transmitted from a bus to individually provide the clock signal, the image signal and the driving signal to the corresponding data drivers; and an LCD panel, electrically connected to the data drivers, for correspondingly receiving a display data output from each of the data drivers to display an image, wherein when a voltage level of a common-mode voltage of the LVDS clock received by the timing controller drops to a reference level by a detection of the flip-flop, a voltage level of the driving signal, which is output from the timing controller and required for driving the plurality of data drivers by the timing controller, is maintained to a high level supply voltage under control of the flip-flop, and output from the data drivers is stopped outputting to the LCD panel in response to the driving signal maintained to the high level supply voltage, such that residual charges within pixel array of the LCD panel is quickly dissipated in response to the stopped output of the data drivers.

23. The LCD as claimed in claim 22 further comprising a plurality of scan drivers electrically connected to the LCD panel, and each of the scan drivers providing a scan signal according to a basic timing to sequentially activate a corresponding row of pixels, such that the row of pixels may correspondingly receive the display data output from each of the data drivers, wherein the basic timing is generated from the LVDS clock after being processed by the timing controller.

24. The LCD as claimed in claim 22, further comprising a power supply unit for providing the high level supply voltage, the reference level and power required for operating the LCD.

25. The LCD as claimed in claim 22, wherein the flip-flop comprises a D flip-flop, a T flip-flop, an RS flip-flop or a JK flip-flop.

* * * * *